US005918849A

United States Patent [19]

Bliss

[11] Patent Number: 5,918,849

[45] Date of Patent: Jul. 6, 1999

[54] TREE STAND WITH A PLURALITY OF PIVOTING ARMS THAT EACH PIVOT ABOUT A VERTICAL AXIS

[76] Inventor: Jon P. Bliss, 1150 W. St. George Ave., Linden, N.J. 07036

[21] Appl. No.: 08/789,000

[22] Filed: Jan. 27, 1997

[51] Int. Cl.[6] ..... F16M 13/00

[52] U.S. Cl. ..... 248/523; 47/40.5; 74/530; 74/411.5; 74/98; 192/223.1

[58] Field of Search ..... 248/523, 519, 248/521, 524, 525, 316.2, 526, 527, 540, 541, 310, 313; 47/40.5; 52/297; 279/38, 35; D11/130.1; 74/530, 411.5, 98; 192/8 R, 223.1

[56] References Cited

U.S. PATENT DOCUMENTS

| | | | |
|---|---|---|---|
| 458,756 | 9/1891 | Merk | 248/521 |
| 1,233,207 | 7/1917 | Elbe | 248/524 X |
| 2,242,270 | 5/1941 | Sims | 248/524 X |
| 2,446,949 | 8/1948 | Neutra | 248/526 X |
| 2,478,278 | 8/1949 | Kiesow | 248/524 X |
| 2,689,701 | 9/1954 | Whitaker | 248/524 |
| 2,913,202 | 11/1959 | Meldrum | 248/523 X |
| 2,933,274 | 4/1960 | Mausolf | 248/524 X |
| 3,958,613 | 5/1976 | Herz . | |
| 4,606,385 | 8/1986 | Williamson . | |
| 4,936,538 | 6/1990 | Royce | 248/524 |
| 5,054,733 | 10/1991 | Shields | 248/313 |
| 5,160,110 | 11/1992 | Praegitzen | 248/523 |
| 5,464,186 | 11/1995 | Robert | 248/524 |
| 5,467,959 | 11/1995 | Behringer | 248/523 |
| 5,490,350 | 2/1996 | Eisenschenk et al. | 248/523 X |

OTHER PUBLICATIONS

Insta–Stand by Invent, Inc. sold in 1987 and invented by Jon P. Bliss. See attached top elevational view.

*Primary Examiner*—Derek J. Berger
*Assistant Examiner*—Stephen S. Wentsler
*Attorney, Agent, or Firm*—David L. Volk

[57] ABSTRACT

A base forms a receptacle for insertion of a tree trunk therein. A ring assembly is connected to a mouth of the base. A plurality of grabbing arms each have a pivoting end connected to the ring assembly and a free end. The grabbing arms are configured to pivot in such a manner as to move the free ends inward and outward. An elongated gripping member is connected to each of the grabbing arms at the free end. The gripping member is oriented substantially perpendicular to a plane of the grabbing arm. A lever arm includes a pivotal connection to the ring assembly. A locking arm is rotatably connected to the pivotal connection. The lever arm is configured to cause the grabbing arms to pivot when the lever arm is pivoted.

7 Claims, 7 Drawing Sheets

TREE STAND WITH A PLURALITY OF PIVOTING ARMS THAT EACH PIVOT ABOUT A VERTICAL AXIS

BACKGROUND OF THE INVENTION

1. Field of the Invention

The present invention relates to tree stands, particularly a tree stand with structure for securing and adjusting the tree within the stand.

2. Description of the Related Art

Christmas trees are a traditional and joyous part of the Christmas celebration for people in countries around the world. Tree stands have long been available for standing a tree in a home or commercial building. These tree stands have usually consisted of a receptacle in which the tree trunk is placed, the receptacle having legs for support on a floor surface. The tree stands also include threaded screws distributed circumferentially near the rim of the receptacle and pointed inward toward the center of the receptacle. These screws are used to hold the tree in place.

A problem with the conventional tree stand is that the screws are cumbersome to use. While holding the tree straight, usually with the help of a second person, the screws must be turned several times to adequately secure the tree in place. The tree must be held straight while the screws are being tightened, to ensure that the tree will be straight when the process is complete. Most tree stands use three screws, distributed evenly around the receptacle. Because the tree is held at just three locations by a relatively slender screw, the tree may not always be successfully secured. Many homeowners can recall watching a tree fall over seemingly on its own, after it had already been decorated.

SUMMARY OF THE INVENTION

The tree stand of the present invention includes a base forming a receptacle for insertion of a tree trunk therein. A ring assembly is connected to a mouth of the base. A plurality of grabbing arms each have a pivoting end connected to the ring assembly and a free end. The grabbing arms are configured to pivot in such a manner as to move the free ends inward and outward. An elongated gripping member is connected to each of the grabbing arms at the free end. The gripping member is oriented substantially perpendicular to a plane of the grabbing arm. A lever arm includes a pivotal connection to the ring assembly. A locking arm is rotatably connected to the pivotal connection. The lever arm is configured to cause the grabbing arms to pivot when the lever arm is pivoted.

Accordingly, several objects and advantages of the present invention are:

a. to provide a tree stand which is easy to use;

b. to provide a tree stand which holds a tree securely; and c. to provide a tree stand which can be operated with one hand.

Still further objects and advantages will become apparent from the ensuing description and drawings.

DETAILED DESCRIPTION

Figure 1:
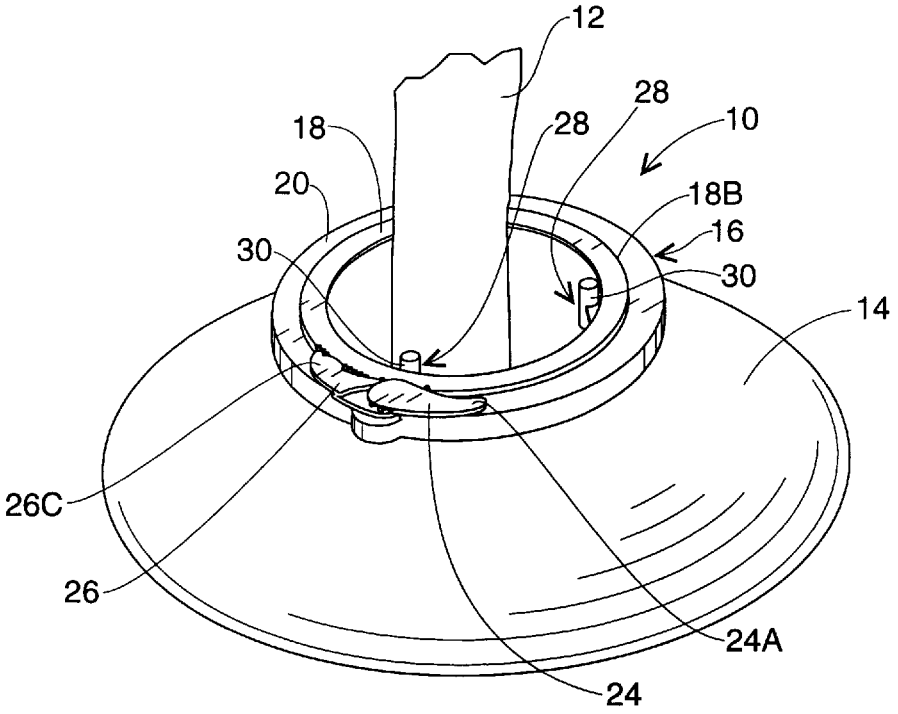
FIG. 1 is a perspective view of a tree stand with a tree trunk in an unsecured condition within the tree stand.

FIG. 1 is a perspective view of a tree stand 10 with a tree trunk 12 in an unsecured condition within the tree stand 10. The tree stand 10 includes a base 14 forming a receptacle for insertion of the tree trunk 12 therein. The base 14 includes a mouth 14A (see FIG. 2) through which the tree trunk 12 is inserted. A ring assembly 16 is rotatably connected to the base 14. The ring assembly 16 includes a first ring 18, a second ring 20, and a third ring 22 (see FIG. 2).

A lever arm 24 and a locking arm 26 are pivotally connected to each other and to the second ring 20. The details of this connection will be described later herein with reference to FIG. 2.

A plurality of grabbing arms 28 are disposed circumferentially about the ring assembly 16. In FIG. 1, the grabbing arms 28 are in a retracted position.

Figure 1A:
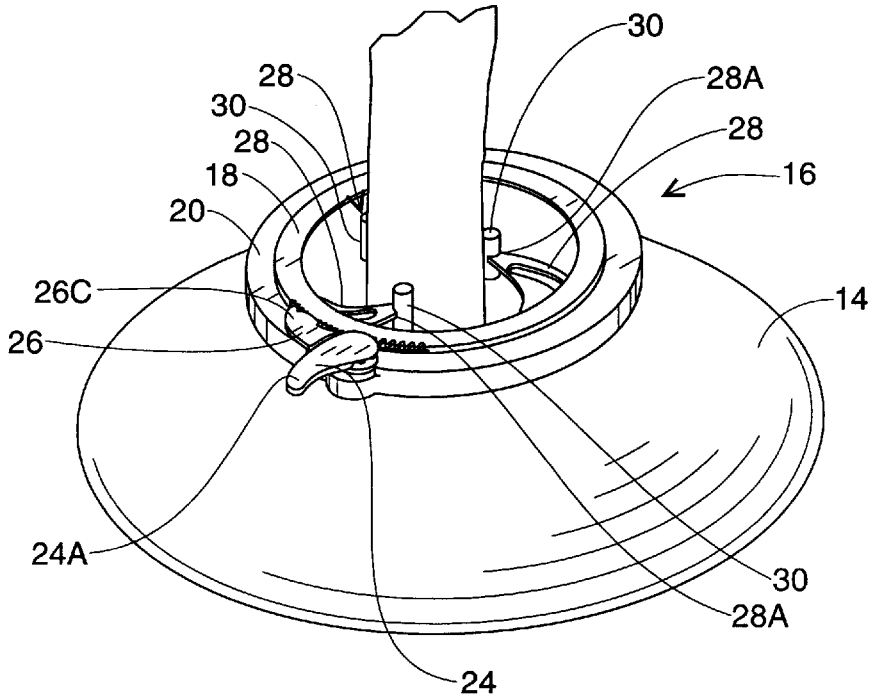
FIG. 1A is a perspective view of the tree stand with a tree trunk secured within the tree stand.

In FIG. 1A, the grabbing arms 28 are in an extended position which holds the tree trunk 12 securely in place. This extended position is achieved by rotating the lever arm 24 such that a lever arm free end 24A is moved away from the ring assembly 16. The operation of the lever arm 24 is explained later herein with reference to other figures.

The grabbing arms 28 each include a cylindrical gripping member 30 connected to a grabbing arm free end 28A and oriented substantially perpendicular to a plane of the grabbing arm 28. The cylindrical gripping member 30 assists in providing a secure grip on the tree trunk 12.

Figure 2:
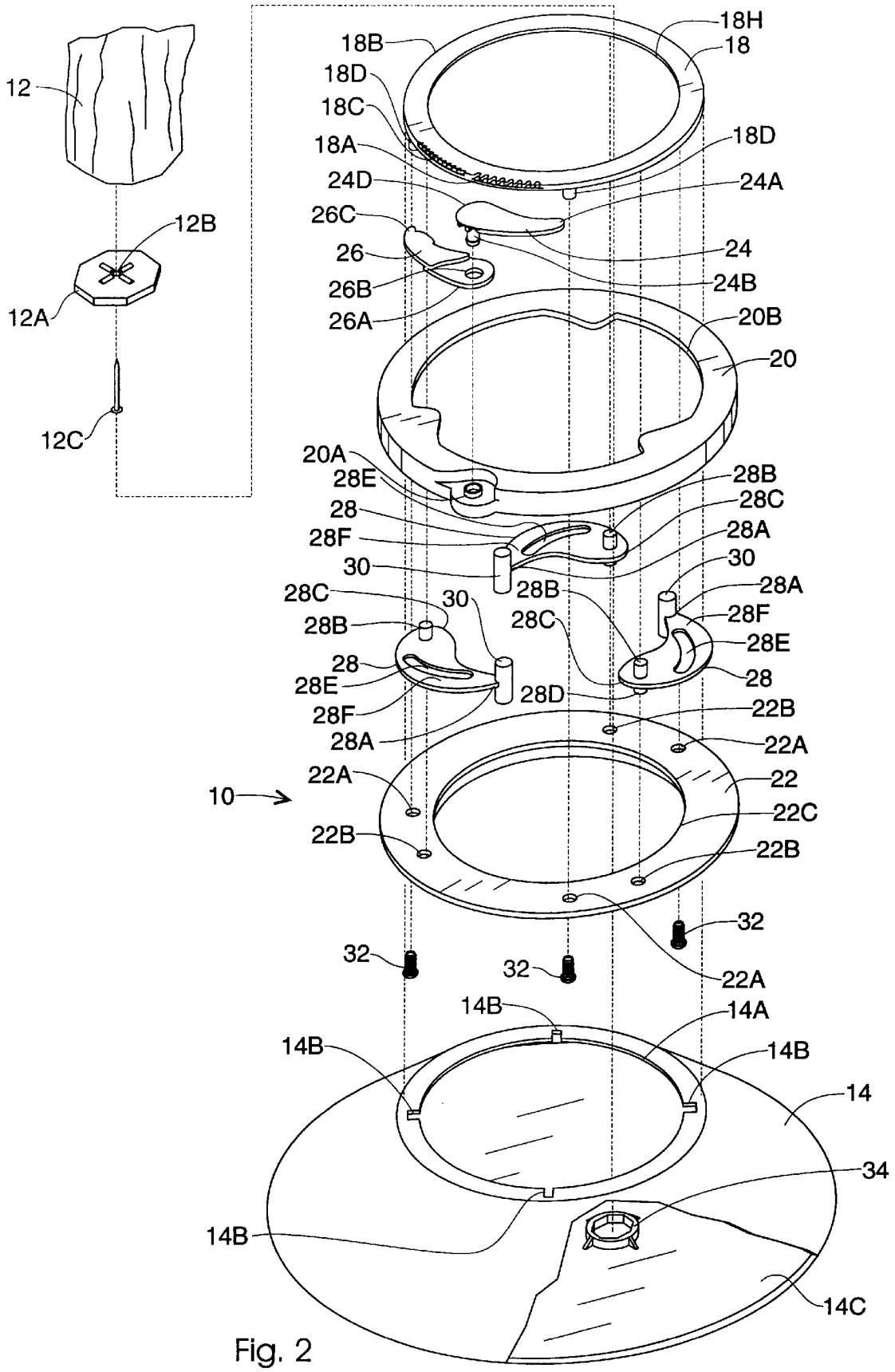
FIG. 2 is a top perspective exploded view of the tree stand.
Figure 3:
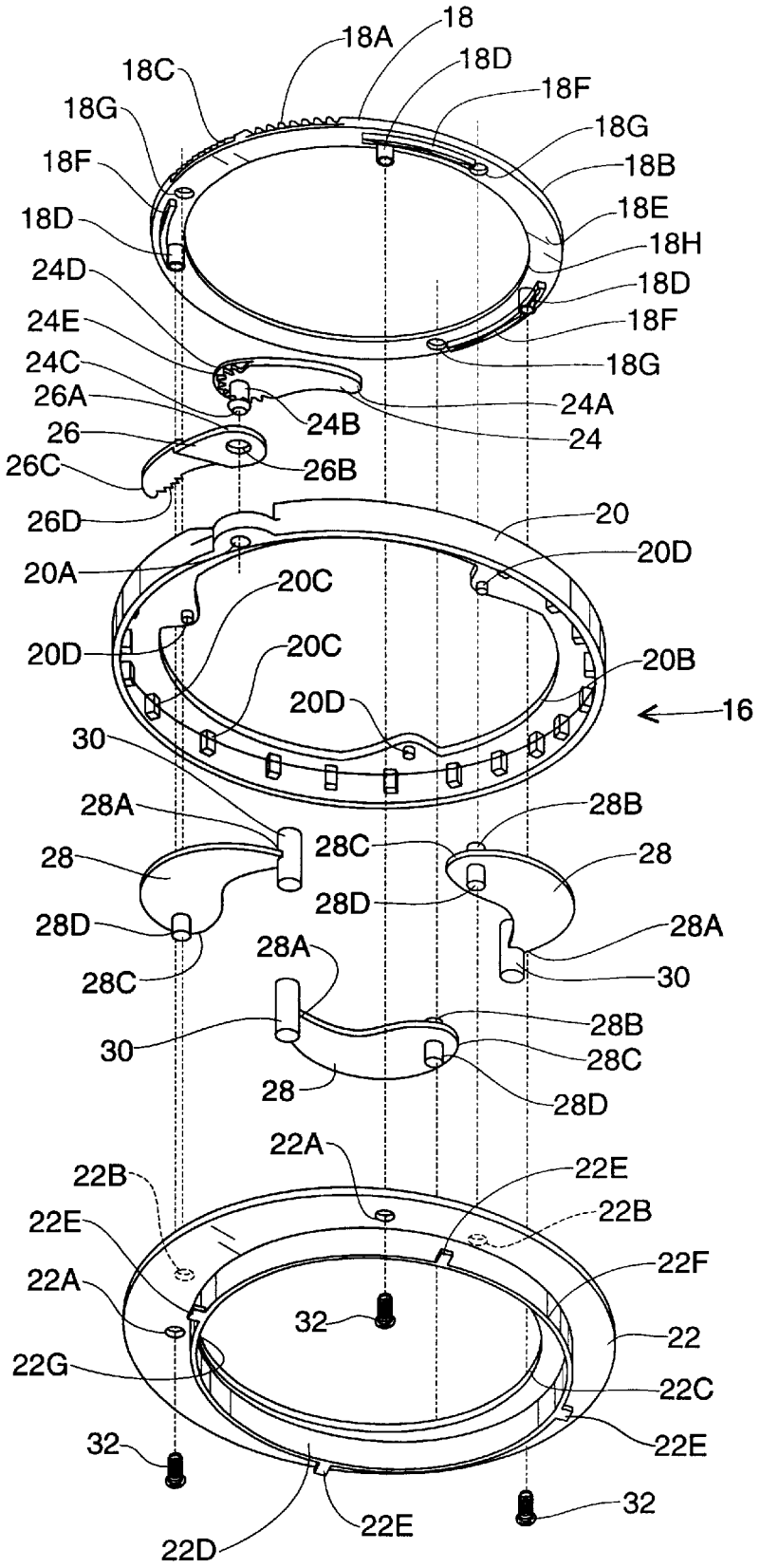
FIG. 3 is a bottom perspective exploded view of the ring assembly and the grabbing arms.

FIG. 2 is a top perspective exploded view of the tree stand 10, and FIG. 3 is a bottom perspective exploded view of the ring assembly 16 and the grabbing arms 28. Referring to FIGS. 2 and 3, the first ring 18 is fixedly connected to the third ring 22 by screws 32 inserted through third ring apertures 22A and threadedly connected to spacing receiving members 18D, which are connected to an underside 18E of the first ring 18. The spacing receiving members 18D hold the third ring 22 away from the first ring 18 to permit the second ring 20 and the grabbing arms 28 to be disposed there-between.

A plurality of guide walls 18F are disposed annularly on the underside 18E of the first ring 18. The guide walls 18F are configured to slidably engage a second ring inner edge 20B. In combination with the fixed connection of the first ring 18 to the third ring 22, the guide walls 18F permit the second ring 20 to rotate relative to the first ring 18 and the third ring 22 and to restrict the second ring 20 from lateral movement with respect to the first ring 18 and the third ring 22.

The second ring 20 includes spacing members 20C disposed annularly about the second ring 20. The spacing members 20C hold the third ring 22 away from the second ring 20 to permit the grabbing arms 28 to be disposed therein.

The first ring 18 includes first ring first teeth 18A along a portion of an outer edge 18B of the first ring 18. The lever arm 24 includes a lever arm pivoting end 24D which is pivotally connected to the second ring 20. A cylindrical connecting member 24B extends from the lever arm pivoting end 24D through an aperture 20A in the second ring 20. The connecting member 24B includes a stop member 24C at a distal end of the connecting member 24B to retain the connecting member 24B within the aperture 20A; thus the lever arm 24 pivots about a longitudinal axis of the connecting member 24B.

The lever arm 24 extends away from the lever arm pivoting end 24D to the lever arm free end 24A. The lever arm 24 comprises lever arm teeth 24E oriented at least partially annularly about the connecting member 24B and configured to engage the first ring first teeth 18A, such that when the lever arm 24 is pivoted, the first ring 18 and the third ring 22 rotate relative to the second ring 20.

The first ring 18 includes first ring second teeth 18C along a portion of the outer edge 18B of the first ring 18 located near the first ring first teeth 18A. A locking arm 26 includes a locking arm pivoting end 26A having a locking arm aperture 26B through which the connecting member 24B is inserted, thus rotatably connecting the locking arm 26 to the connecting member 24B between the lever arm 24 and the second ring 20. The locking arm 26 extends away from the locking arm pivoting end 26A to a locking arm free end 26C.

The locking arm 26 comprises locking arm teeth 26D between the locking arm pivoting end 26A and the locking arm free end 26C. The locking arm teeth 26D are oriented and configured to engage the first ring second teeth 18C when the locking arm 26 is rotated such that the locking arm free end 26C is adjacent the outer edge 18B of the first ring 18 as shown in FIG. 1. As also shown in FIG. 1, the lever arm 24 and the locking arm 26 extend away from each other when the lever arm free end 24A and the locking arm free end 26C are each positioned adjacent the outer edge 18B of the first ring 18.

A plurality of first recesses 18G are disposed annularly about the first ring 18 on the underside 18E of the first ring 18. A plurality of second recesses 22B are disposed annularly about the third ring 22. The second recesses 22B are aligned opposite the first recesses 18G. Each of the grabbing arms 28 includes a first pivot pin 28B near a grabbing arm pivoting end 28C. Each of the first pivot pins 28B is pivotally engaged within one of the first recesses 18G. A second pivot pin 28D shares a common longitudinal axis with the first pivot pin 28B and is pivotally engaged within the second recess 22B.

Each of the grabbing arms 28 includes a track 28E formed within a first surface 28F of the grabbing arm 28 and extending from near the grabbing arm pivoting end 28C to near the grabbing arm free end 28A.

The second ring 20 includes a plurality of pins 20D depending toward the third ring 22. Each of the pins 20D are slidably engaged within one of the tracks 28E (see FIGS. 4 and 5).

The third ring 22 includes a circular third ring inner edge 22C. The third ring inner edge 22C aligns with the second ring inner edge 20B and a first ring inner edge 18H. A collar 22D depends from the third ring 22 toward the base 14. The collar 22D includes outward depending tabs 22E distributed about a perimeter 22F of the collar 22D. The collar 22D is sized to fit within the mouth 14A of the base 14. The mouth 14A includes structure forming notches 14B distributed about the mouth 14A at intervals matching the tabs 22E. The ring assembly 16 is positioned on the base 14 by passing the tabs 22E through the notches 14B.

The collar 22D has a collar inside radius which is larger than a radius of the third ring inner edge 22C. The collar 22D surrounds the third ring inner edge 22C and is tangential to the third ring inner edge 22C at a single point 22G.

A nailing plate 12A is provided with a plate aperture 12B therein through which a nail 12C may be inserted to secure the nailing plate 12A to the bottom of the tree stump 12. A plate receptacle 34 is mounted to a floor 14C of the base 14. The plate receptacle 34 is configured to snugly receive the nailing plate 12A therein, thus holding the bottom of the tree stump 12 in place.

Figure 4:
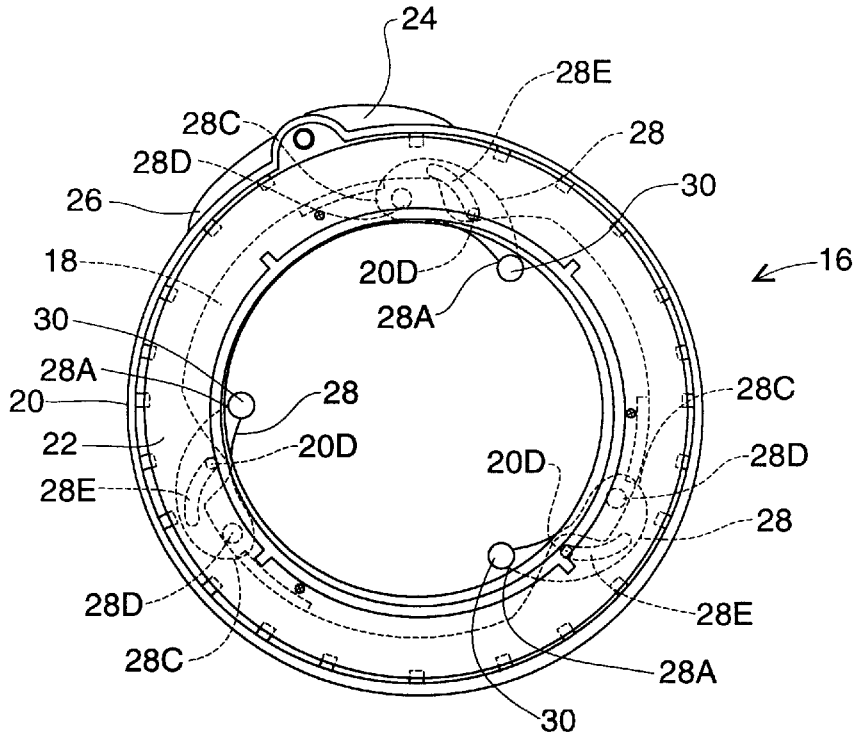
FIG. 4 is a bottom elevational view of the ring assembly with the grabbing arms in a retracted position.
Figure 5:
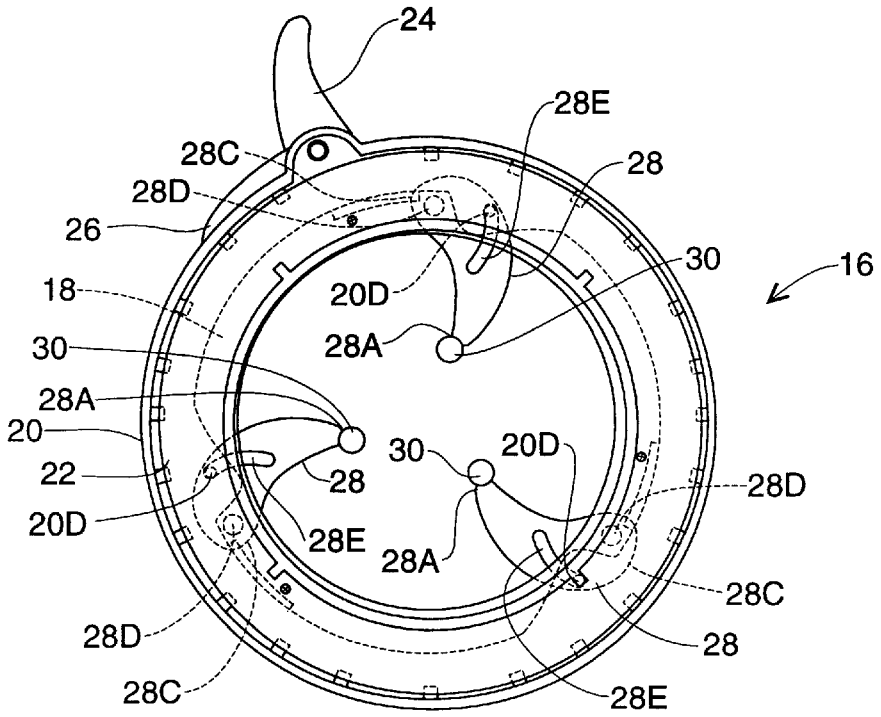
FIG. 5 is a bottom elevational view of the ring assembly with the grabbing arms in an extended position.

FIG. 4 is a bottom elevational view of the ring assembly 16 with the grabbing arms 28 in a retracted position. FIG. 5 is a bottom elevational view of the ring assembly 16 with the grabbing arms 28 in an extended position. In FIG. 4, the lever arm 24 is in a position wherein the lever arm free end 24A is adjacent the outer edge 18B of the first ring 18, as shown in FIG. 1. The pin 20D is at the end of the track 28E which is closest to the grabbing arm free end 28A. In FIG. 5, the lever arm 24 is rotated, causing the second ring 20 to rotate relative to the first and third rings 18, 22. This causes the pins 20D to travel along the tracks 28E to the end of the track 28E which is closest to the grabbing arm pivoting end 28C, which causes the grabbing arm free end 28A to move inward toward the extended position.

Figure 6:
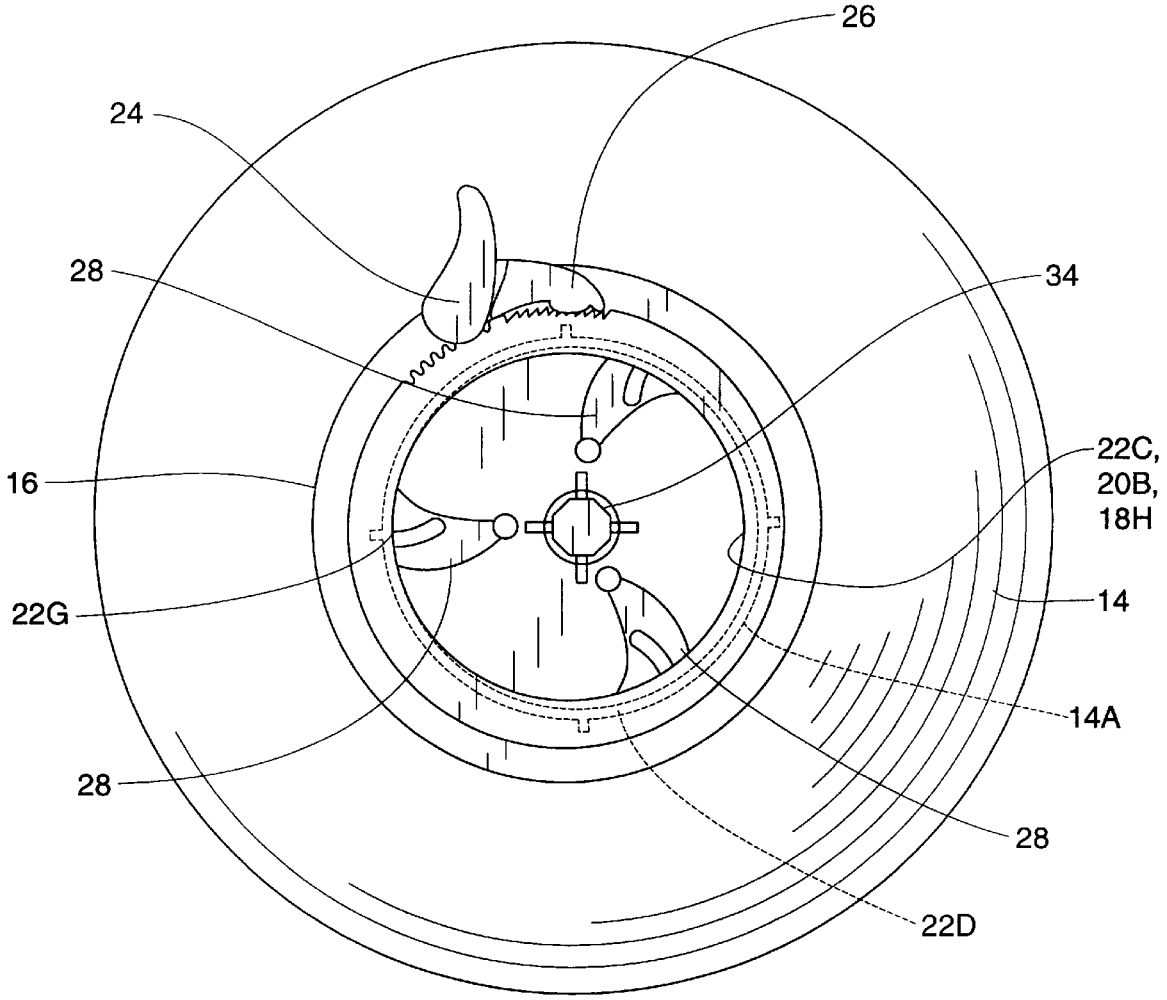
FIG. 6 is a top plan view of the tree stand.

FIG. 6 is a top plan view of the tree stand 10. The collar 22D is inserted into the mouth 14A of the base 14. The collar 22D is free to rotate within the mouth 14A. In the particular position shown, the grabbing arms 28 are converging toward a point which is directly above the center of the plate receptacle 34. Because the third ring inner edge 22C and the collar 22D do not share a common center, the grabbing arms 28 will not converge toward a point which is directly above the center of the plate receptacle 34 when the ring assembly 16 is rotated to any other position than the one shown in FIG. 6. Because trees do not tend to be perfectly straight, this configuration permits a person to straighten the tree by rotating the ring assembly 16 with respect to the base 14 after the tree trunk 12 has been inserted into the base 14 and the grabbing arms 28 have been rotated to the extended position to secure the tree in place. As the ring assembly 16 rotates, the position of the portion of the tree trunk 12 between the grabbing arms 28 changes in relation to the bottom of the tree trunk 12 which is held in place by the plate receptacle 34.

Figure 7:
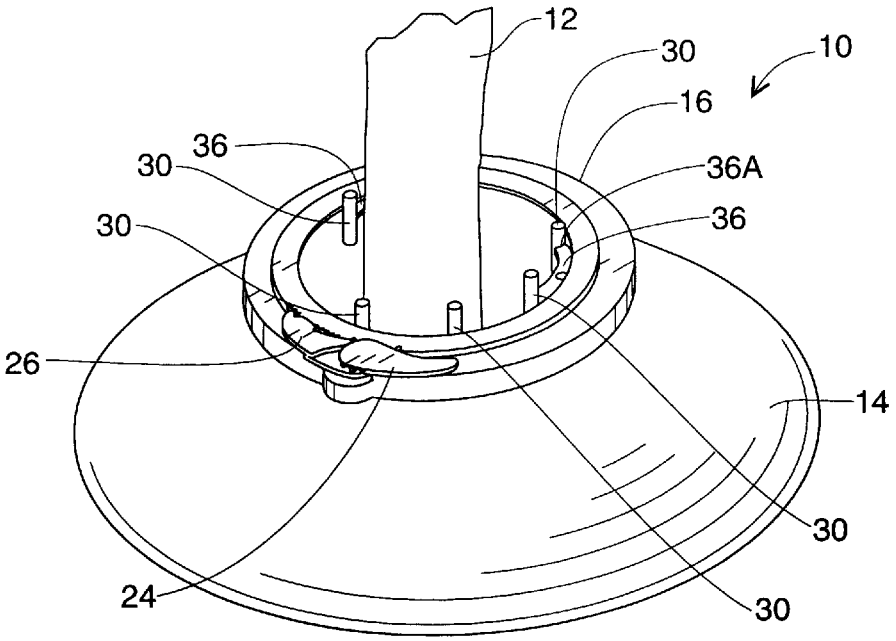
FIG. 7 is a perspective view of an alternative embodiment of the tree stand with a tree trunk in an unsecured condition within the tree stand.
Figure 7A:
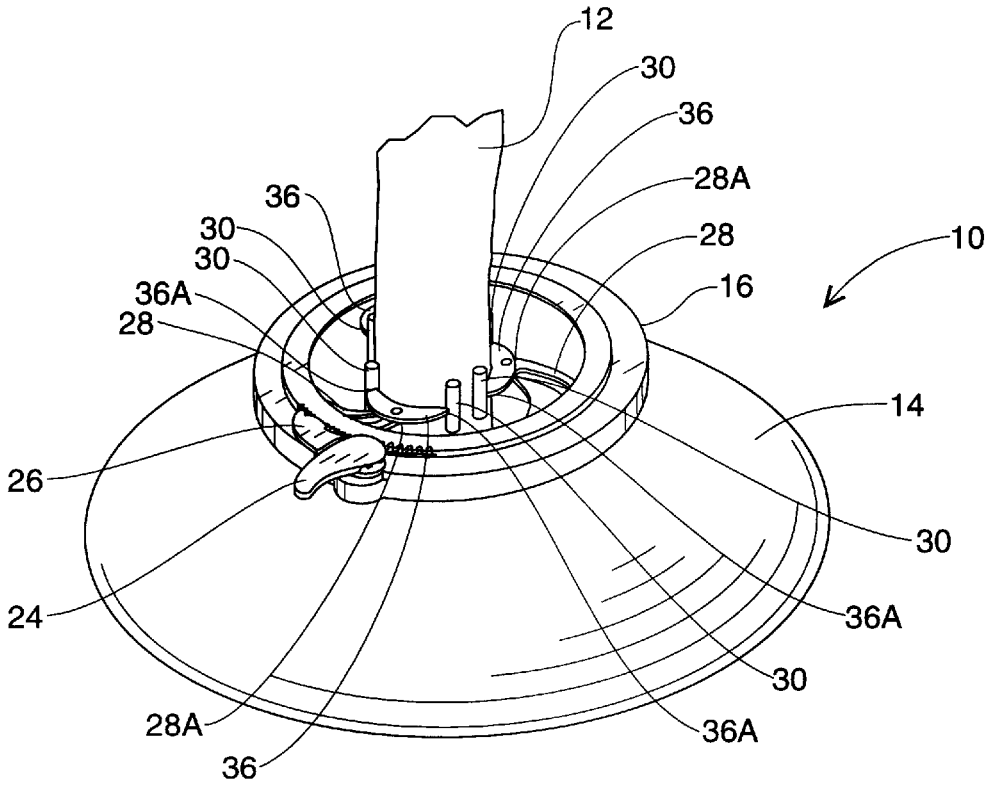
FIG. 7A is a perspective view of the alternative embodiment of the tree stand with a tree trunk secured within the tree stand.

FIG. 7 is a perspective view of an alternative embodiment of the tree stand 10 with the grabbing arms 28 in the retracted position; thus the tree trunk 12 is in an unsecured condition within the tree stand 10. FIG. 7A is a perspective view of the alternative embodiment of the tree stand 10 with the grabbing arms 28 in an extended position, thus securing the tree trunk 12 within the tree stand 10. In this alternate embodiment, a rocker arm 36 is pivotally connected to the grabbing arm free end 28A of each of the grabbing arms 28. Each of the rocker arms 36 includes two ends 36A and a cylindrical gripping member 30 connected to each of the ends 36A and oriented substantially perpendicular to a plane of the rocker arm 28.

Figure 8:
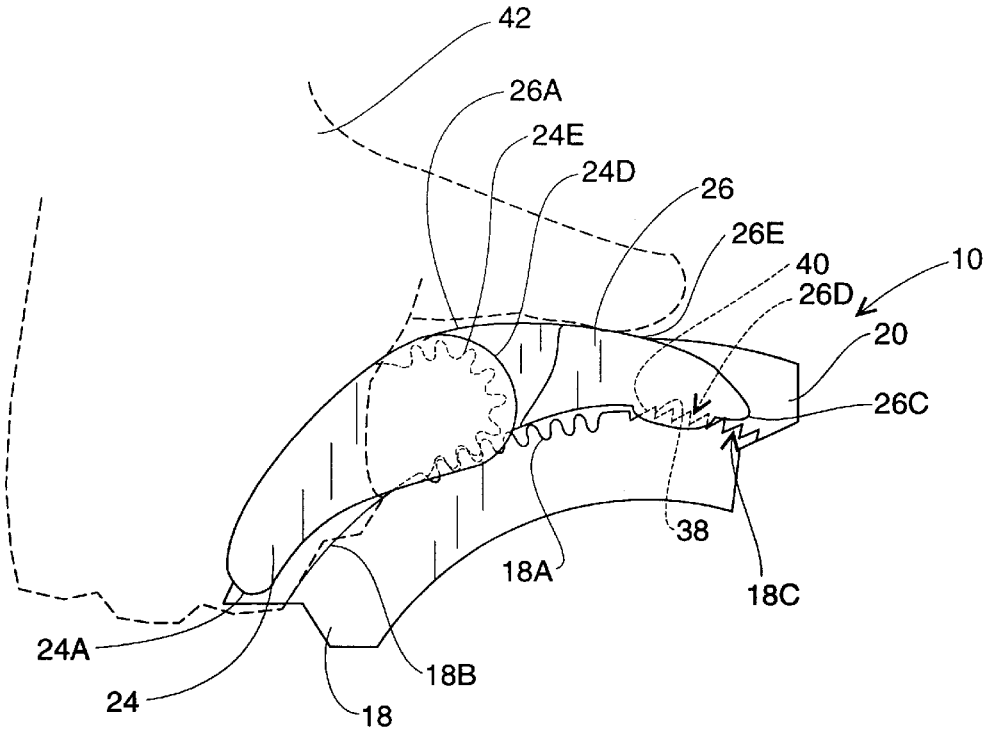
FIG. 8 is a partial top plan view of the tree stand showing the lever arm and the locking arm in a first position.

FIG. 8 is a partial top plan view of the tree stand 10 in use, showing the lever arm 24 and the locking arm 26 in a first position in which the lever arm free end 24A and the locking arm free end 26C are each near the outer edge 18B of the first ring 18. In this position, the grabbing arms 28 (not shown in this figure) are in a retracted position, as shown in FIG. 1. As already described with reference to FIGS. 2 and 3, the locking arm 26 includes the locking arm teeth 26D between the locking arm pivoting end 26A and the locking arm free end 26C. The locking arm teeth 26D are oriented and configured to engage the first ring second teeth 18C when the locking arm 26 is positioned as shown in FIG. 8. As also previously described, the lever arm 24 and the locking arm 26 extend away from each other when they are positioned as shown in FIG. 8. Also as previously described, the lever arm teeth 24E engage the first ring first teeth 18A.

The first ring second teeth 18C and the locking arm teeth 26D have first facing edges 38. The first facing edges 38 of the first ring second teeth 18C are oriented radially with respect to the first ring 18. The first facing edges 38 of the locking arm teeth 26D are oriented parallel to the first facing edges 38 of the first ring second teeth 18C when the first ring second teeth 18C and the locking arm teeth 26D are engaged as shown in FIG. 8.

The first ring second teeth 18C and the locking arm teeth 26D have second facing edges 40. The second facing edges 40 of the first ring second teeth 18C form a substantially acute angle with the first facing edges 38 of the first ring second teeth 18C. The second facing edges 40 of the locking arm teeth 26D are oriented parallel to the second facing edges 40 of the first ring second teeth 18C when the first ring second teeth 18C and the locking arm teeth 26D are engaged as shown in FIG. 8.

Figure 8A:
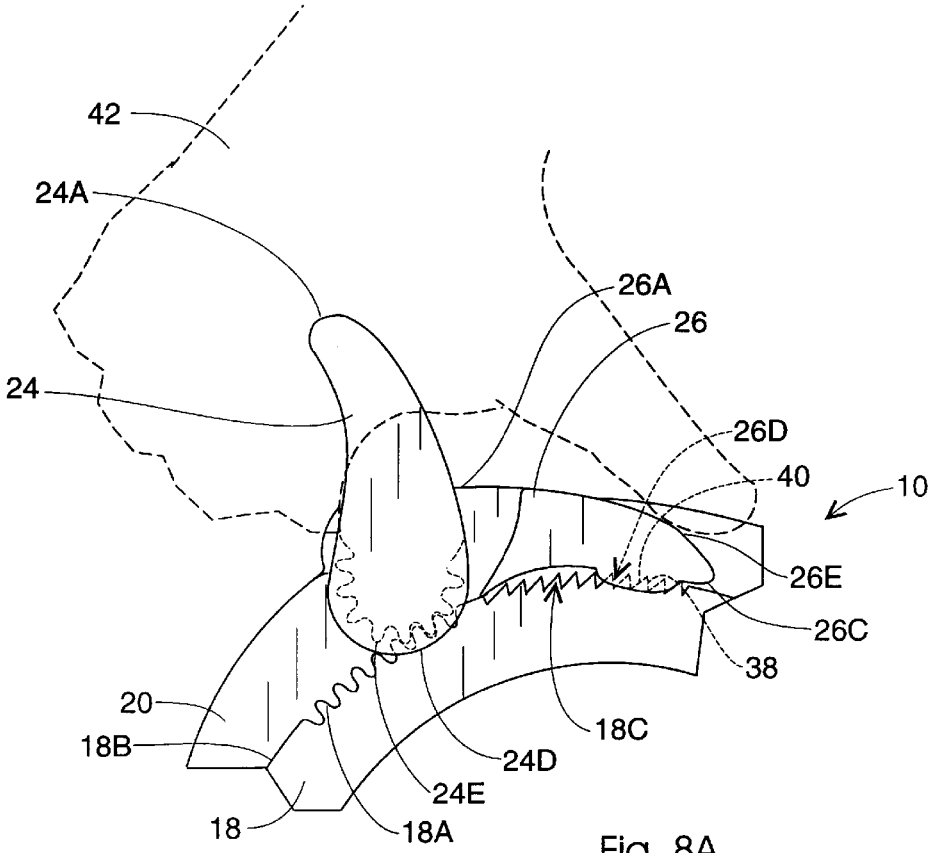
FIG. 8A is a partial top plan view of the tree stand showing the lever arm and the locking arm in a second position.

FIG. 8A is a partial top plan view of the tree stand 10 in use showing the lever arm 24 and the locking arm 26 in a second position in which the lever arm free end 24A is rotated away from the outer edge 18B of the first ring 18. In this position, the grabbing arms 28 (not shown in this figure) are in an extended position as shown in FIG. 1A.

Referring to FIGS. 8 and 8A, to use the invention, a tree (not shown) is placed within the base 14 while the lever arm 24 and the locking arm 26 are positioned as shown in FIG. 8. A user grips the lever arm 24 with the fingers of a hand 42 between the lever arm free end 24A and the lever arm pivoting end 24D. The thumb of the hand 42 is placed on a back edge 26E of the locking arm 26. As the user rotates the lever arm 24 toward the position shown in FIG. 8B, the user places moderate pressure on the locking arm 26 with the thumb, in the direction of the first ring 18. The second facing edges 40 slide relative to each other and the first ring 18 is permitted to rotate relative to the second ring 20. The locking arm 26 jumps toward the thumb as the sliding motion of the second facing edges 40 relative to each other causes the locking arm teeth 26D to alternately engage and disengage with the first ring second teeth 18C.

When the position shown in FIG. 8A is reached, the user exerts a final bit of pressure with the thumb against the locking arm 26 in the direction of the first ring 18, fully engaging the locking arm teeth 26D with the first ring second teeth 18C. Because the first facing edges 38 of the first ring second teeth 18C are oriented radially with respect to the first ring 18, and the first facing edges 38 of the locking arm teeth 26D are oriented parallel to the first facing edges 38 of the first ring second teeth 18C, the first ring 18 is restrained from rotation relative to the second ring 20 in a direction back toward the position shown in FIG. 8, thus securing the grabbing arms 28 in an extended position, holding the tree stump 12 firmly in place.

To permit rotation of the lever arm 24 and the first ring 18 back toward the first position as shown in FIG. 8, the user rotates the locking arm 26 away from the first ring 18, thereby disengaging the locking arm teeth 26D from the first ring second teeth 18C.

The foregoing description is included to describe embodiments of the present invention which include the preferred embodiment, and is not meant to limit the scope of the invention. From the foregoing description, many variations will be apparent to those skilled in the art that would be encompassed by the spirit and scope of the invention. The scope of the invention is to be limited only by the following claims and their legal equivalents.

The invention claimed is:

1. A tree stand comprising:

a first ring having an underside and a plurality of first recesses disposed annularly about the first ring on the underside;

a second ring;

a third ring;

a base forming a receptacle for insertion of a trunk of a tree therein;

the third ring rotatably attachable to a mouth of the base;

the second ring disposed between the first ring and the third ring;

the first ring fixedly connected to the third ring;

a guide means configured to permit the second ring to rotate relative to the first ring and the third ring and restricting the second ring from lateral movement relative to the first ring and the third ring;

the first ring having first ring first teeth along a portion of an outer edge of the first ring;

a lever arm having a lever arm pivoting end, the lever arm pivoting end having a pivotal connection to the second ring, the lever arm extending away from the lever arm pivoting end to a lever arm free end, the lever arm comprising lever arm teeth oriented at least partially annularly about the pivotal connection and configured to engage the first ring first teeth, such that when the lever arm is pivoted about the pivotal connection, the first ring and the third ring rotate relative to the second ring;

the first ring having first ring second teeth along a second portion of the outer edge of the first ring located near the first ring first teeth;

a locking arm having a locking arm pivoting end rotatably connected to the pivotal connection;

the locking arm extending away from the locking arm pivoting end to a locking arm free end;

the locking arm comprising locking arm teeth between the locking arm pivoting end and the locking arm free end, the locking arm teeth oriented and configured to engage the first ring second teeth when the locking arm is rotated such that the locking arm free end is adjacent the outer edge of the first ring;

the first ring second teeth and the locking arm teeth having first facing edges;

the first facing edges of the first ring second teeth oriented radially with respect to the first ring;

the first facing edges of the locking arm teeth oriented parallel to the first facing edges of the first ring second teeth when the first ring second teeth and the locking arm teeth are engaged;

the first ring second teeth and the locking arm teeth having second facing edges;

the second facing edges of the first ring second teeth forming a substantially acute angle with the first facing edges of the first ring second teeth;

the second facing edges of the locking arm teeth oriented parallel to the second facing edges of the first ring second teeth when the first ring second teeth and the locking arm teeth are engaged;

the lever arm and the locking arm extending away from each other when the lever arm free end and the locking arm free end are each positioned adjacent the outer edge of the first ring;

the third ring having a plurality of second recesses aligned opposite a corresponding one of the first recesses;

a plurality of grabbing arms each having a grabbing arm pivoting end and a grabbing arm free end;

each of the grabbing arms having a first pivot pin near the grabbing arm pivoting end and pivotally engaged within one of the first recesses and a second pivot pin sharing a common longitudinal axis with the first pivot pin and pivotally engaged within one of the second recesses;

each of the grabbing arms having a track formed within a first surface of the grabbing arm and extending from near the grabbing arm pivoting end to near the grabbing arm free end;

the second ring having a plurality of pins depending toward the third ring, each of the pins slidably engaged within one of the tracks, and the track, the first and second pivot pins of each of the plurality of the grabbing arms and the plurality of pins of the second ring configured such that when the first ring and the third ring rotate in a first direction relative to the second ring, the pins of the second ring travel within the corresponding track of each of the grabbing arms such that each of the grabbing arms rotate about its grabbing arm pivoting end and the grabbing arm free end moves inward towards a central axis of the tree stand, and when the first ring and the third ring rotate in a second direction relative to the second ring, the pins of the second ring travel within the corresponding track of each of the grabbing arms such that each of the grabbing arms rotates about its grabbing arm pivoting end and the grabbing arm free end moves outward from the central axis of the tree stand.

2. The tree stand of claim 1, wherein each of the plurality of grabbing arms includes a tree gripping means connected to the grabbing arm free end, the tree gripping means comprising at least one cylindrical member oriented substantially perpendicular to a plane of the plurality of grabbing arms.

3. The tree stand of claim 1, wherein each of the plurality of grabbing arms includes a tree gripping means connected to the grabbing arm free end, the tree gripping means comprising at least one elongated member oriented substantially perpendicular to a plane of the plurality of grabbing arms.

4. The tree stand of claim 1, wherein each of the plurality of grabbing arms includes a rocker arm pivotally connected to the grabbing arm free end.

5. The tree stand of claim 4, wherein each of the plurality of rocker arms includes two ends and an elongated gripping member connected to each of the ends and oriented substantially perpendicular to a plane of the plurality of rocker arms.

6. The tree stand of claim 4, wherein each of the plurality of rocker arms includes two ends and a cylindrical gripping member connected to each of the ends and oriented substantially perpendicular to a plane of the plurality of rocker arms.

7. In an improved tree stand having a base forming a receptacle for insertion of a tree trunk therein, a ring assembly connectable to a mouth of the base, a lever arm rotatably connected to the ring assembly and configured to rotate a first portion of the ring assembly relative to a second portion of the ring assembly, a locking arm rotatably connected to the ring assembly and configured to restrict the first portion of the ring assembly from rotation relative to the second portion of the ring assembly when a locking arm free end is positioned adjacent the ring assembly, and a plurality of grabbing arms each having a pivoting end connected to the ring assembly and a free end and configured to pivot in such a manner as to move the free ends toward and away from a center of the ring assembly when the first portion of the ring assembly is rotated relative to the second portion of the ring assembly, the improvement comprising the locking arm extending away from the lever arm when a lever arm free end and the locking arm free end are each positioned adjacent the ring assembly, the lever arm and the locking arm sharing a common pivot connection to the ring assembly, and the lever arm and the locker arm adapted to be manipulated simultaneously by a single human hand.

* * * * *